United States Patent [19]

Vögele et al.

[11] Patent Number: 4,472,924

[45] Date of Patent: Sep. 25, 1984

[54] APPARATUS FOR GAS-TREATMENT AND CLOSURE OF PACKAGING CONTAINERS

[75] Inventors: Günther Vögele, Schönaich; Norbert Buchner, Winnenden, both of Fed. Rep. of Germany

[73] Assignee: Robert Bosch GmbH, Stuttgart, Fed. Rep. of Germany

[21] Appl. No.: 396,528

[22] Filed: Jul. 8, 1982

[30] Foreign Application Priority Data

Aug. 1, 1981 [DE] Fed. Rep. of Germany ..... 3130616

[51] Int. Cl.[3] ..... B65B 31/04

[52] U.S. Cl. ..... 53/511; 53/329

[58] Field of Search ..... 53/510, 511, 526, 527, 53/559, 329, 282, 432, 433, 555, 550

[56] References Cited

U.S. PATENT DOCUMENTS

| | | | |
|---|---|---|---|
| 3,090,174 | 5/1963 | Kraft | 53/511 X |
| 3,360,382 | 12/1967 | Miller | 53/432 X |
| 3,701,229 | 10/1972 | Zelnick | 53/511 X |
| 3,745,742 | 7/1973 | Tartarini | 53/511 |
| 3,902,302 | 9/1975 | Tartarini | 53/511 |
| 3,908,342 | 9/1975 | Raque | 53/329 |
| 4,294,859 | 10/1981 | Lundquist et al. | 53/433 X |

FOREIGN PATENT DOCUMENTS

| | | | |
|---|---|---|---|
| 1923608 | 11/1969 | Fed. Rep. of Germany | 53/511 |
| 2421531 | 11/1974 | Fed. Rep. of Germany . | |

*Primary Examiner*—Robert L. Spruill
*Assistant Examiner*—Donald R. Studebaker
*Attorney, Agent, or Firm*—Edwin E. Greigg

[57] ABSTRACT

An apparatus for shaping, filling and closing packaging containers is proposed. In order to create an inert gas atmosphere in the head room of packaging containers which are to be closed with a foil strip and in order to distribute portions of a product in the containers, the apparatus has a gas-treatment device having a chamber which narrows toward the closure device. This chamber is defined at the top by the foil strip moving toward it, which is supported by a slide track, and at the bottom by the containers. Protruding into this chamber in the direction in which the containers are conveyed and overlapping the lateral rims of the containers are gas supply lines, which have gas outlet openings directed transversely with respect to their longitudinal axis. The outlet openings are disposed in staggered fashion on sides of the gas supply lines which face one another.

4 Claims, 5 Drawing Figures

APPARATUS FOR GAS-TREATMENT AND CLOSURE OF PACKAGING CONTAINERS

BACKGROUND OF THE INVENTION

The invention is based on an apparatus for the gas-treatment and closure of packaging containers as revealed hereinafter. In an apparatus of this kind which has become known from German Offenlegungsschrift No. 24 21 531, for example, the gas supply lines protrude between the container and the foil strip extending toward the container at a flat angle in the direction of the closure device. By disposing the gas supply lines above the central axis of one row of containers, uniform gas distribution is attained if the product settles in the containers such that the surface of the product is level. However, it would also be desirable to have an apparatus with which containers could be closed in a protective-gas atmosphere, for instance those in which portions of the product which are pasty or lumpy and pasty, determined by the filler, have been filled into the container as a pile or stack, the upper part of the pile protruding beyond the opening of the container.

OBJECT AND SUMMARY OF THE INVENTION

The apparatus according to the invention has the advantage that the protruding pile of the portions of product is distributed within the container by the supported foil strip, at the same time experiencing the flow of protective gas, yet without coming into contact with any element foreign to the container. The containers may have the shape of a bowl and may be interconnected in chain-like fashion, or in the case of individual containers such as beakers, bowls and the like, it is possible to use a conveyor apparatus having plates, which together with the containers forms the lower limiting surface for the wedge-shaped gas-treatment chamber.

By means of the characteristics disclosed in the dependent claims, advantageous further embodiments of the apparatus disclosed in the main claim can be attained. In a particularly advantageous embodiment of the invention, in which the gas outlet openings are disposed at either of the two sides facing one another of the gas supply lines, the gas outlet openings being offset in staggered fashion, a gas flow which is substantially serpentine in form is established, so that the headroom of the container and the piled-up product are well flushed with protective gas; as a result, the consumption of gas becomes quite low.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
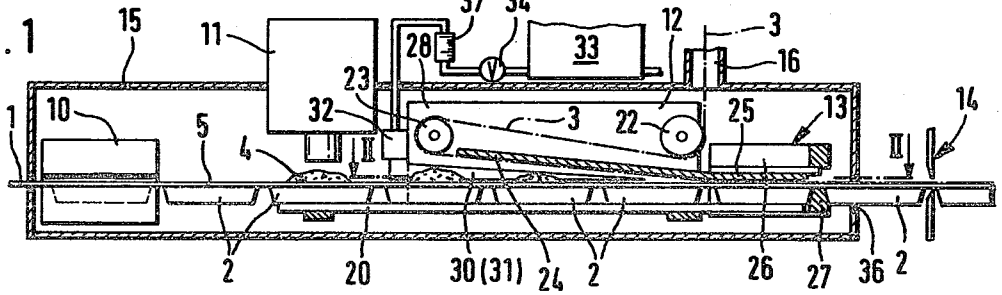
FIG. 1, in a simplified cross section, shows an apparatus for shaping, filling and closing containers.

The apparatus for shaping, filling and closing containers has in sequence a shaping device 10, in which bowl-shaped containers 2 are shaped from a strip 1 of packaging material and spaced apart uniformly from one another; a filling device 11; a gas-treatment device 12 and a closure device 13, in which a foil strip 3 is sealed to the rims 5 of the interconnected containers 2, which after being closed are separated from one another by a cutting device 14. The devices 10–13 for shaping, filling, gas-treating and closing the containers 2 are disposed in a chamber 15, in which an aseptic atmosphere is maintained by means of initial sterilization and the subsequent supplying of a sterile gas at an overpressure; the purpose is to assure germ-free packaging of perishable products such as foodstuffs. Food that contains fat spoils particularly readily in the presence of oxygen, as does feed for animals; so in order to exclude oxygen from the air, a device 12 for supplying an inert gas and maintaining a protective-gas atmosphere is disposed in the apparatus between the filling device 11 and the closure device 13.

Figure 3:
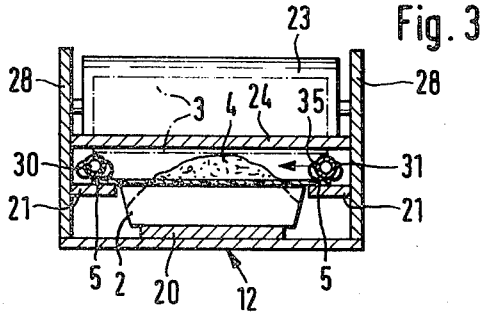
FIG. 3 shows the gas-treatment device of FIG. 2 in a cross sectional view taken along the plane III—III of FIG. 2.

In the vicinity of the gas-treatment device 12, the filled containers 2 delivered by a conveyor apparatus (not shown) are carried by a supporting belt 20, and their laterally offstanding rims 5 are guided by strips 21. The foil strip 3, which after passing through a sterilizing device (not shown) travels through a conduit 16 into the chamber 15, is guided via two deflector rollers 22, 23, so that over a specific path in front of the closure device 13, the foil strip 3 travels above the container 2. To this end, the second deflector roller 23 is disposed at a distance above the containers 2 such that its lower jacket line is spaced apart from the surface or rims 5 of the containers 2 by a distance that is somewhat greater than an amount of protrusion of the piled-up product portions placed into the containers 2. In this manner, the foil strip 3 is guided in a plane which extends toward the closure device 13 inclined at an acute angle relative to the plane of the containers 2. Between this deflector roller 23 and the closure device 13, a plate 24 is disposed in a stationary manner, the underside of this plate being located in the above-described, inclined plane and representing a supporting slideway or track for the foil strip 3. Shortly before the front edge of the closure device 13, a protrusion 25 adjoins the plate 24, extending into the U-shaped upper welding tool 26 of the closure device; the underside of this protrusion 25 extends at a slight distance from and parallel to the top of the containers 2. The plate 24, the strips 21 and the supporting belt 20 are firmly connected with two side plates 28. Refer now to FIG. 3. Between the plate 24 and the strips 21, two tubes 30, 31 which taper in height and are connected to a gas distributor 32 protrude into the wedge-shaped chamber defined by the strips 21. Inert gas is supplied to the gas distributor 32 (FIG. 1) from a reservoir thereof in an adjustable manner by means of a sterile filter 33, a throttle valve 34 and a quantity meter 37.

The two tubes 30, 31 extend longitudinally, overlapping the lateral rims 5 of the containers 2 and the foil strip 3 in the vicinity of the gas-treatment device 12. On the sides of the tubes 30, 31 facing one another, there are gas outlet openings having a flow direction which extends transversely with respect to the direction in which the containers 2 are conveyed. The gas outlet openings 35 are disposed on a tube 30, 31 spaced apart by two container lengths from one another, offset from one another by one container length on the respective facing sides of the two tubes. The result of this disposition is that a substantially serpentine gas flow (arrows) flows through the wedge-shaped chamber defined at top and bottom between the foil strip 3 and the containers 2, beginning at the tip of this chamber; a combined transverse and countercurrent flow exists in the gas-treatment device 12. With this flow, which also effects thorough flushing of the interstices between the portions 4 of the product in the containers, very low oxygen figures in the closed containers 2 are attained, yet the gas consumption is low.

The portions 4 of the product placed in the containers 2 by the filling device 11, which have the tendency to pile up because of the pasty, pulpy or pulpy and lumpy consistency of the product, are poured into the containers 2 to form piles whose tips protrude beyond the container opening. While these piles are experiencing the flow around them of protective gas, the foil strip 3, which is arriving at an angle and is supported by the plate 24, presses down the tip of the pile in the course of the advancement of the containers 2 and the foil strip 3, distributing the product uniformly in the containers 2.

The foil strip 3 which rests on the rims of the containers 2 at the end of the gas-treatment device 12 continues to be held down by the protrusion 25 of the plate 24 and is sealed with a U-shaped sealing seam 6 of the closure device 13 to the respectively supplied container 2 by the tools 26, 27, which are pressed against one another. In this connection it is to be noted that the transverse portion of one seam forms both the rear closure seam of the container preceding that seam and the front closure seam of the container 2 following it. After the still-interconnected containers 2 leave by way of an outlet slit 36 in the chamber 15, the sealed containers 2 are cut apart from one another by the cooperation of the elements comprising the cutting device 14.

Figure 4:
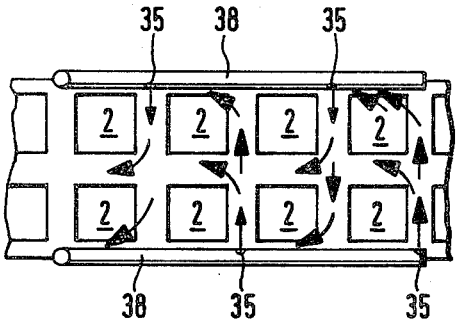
FIG. 4, in a simplified plan view, shows a gas-treatment device for containers which are delivered in two rows.

In the illustrated exemplary embodiment, interconnected containers 2 disposed in a single row are filled, gas-treated and closed. In FIG. 4, an exemplary embodiment is shown in simplified fashion in which interconnected containers 2 in two rows are processed. One gas supply tube 38 is disposed above the free lateral rims of each row of containers. Each gas supply tube 38 has gas outlet openings 35 spaced apart by two container lengths and offset from one another at opposite sides by one container length.

Figure 2:
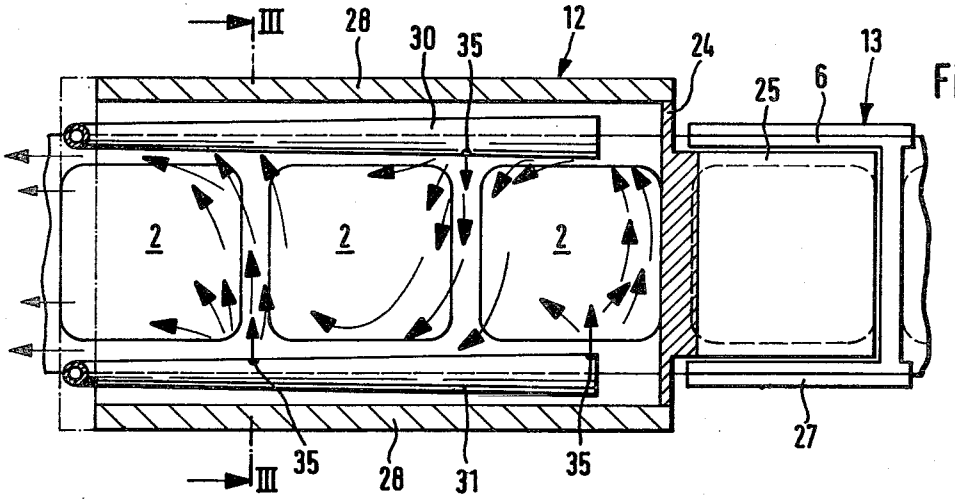
FIG. 2 shows a gas-treatment device of the apparatus of FIG. 1, seen in a longitudinal section taken along the plane II—II of FIG. 1.
Figure 5:
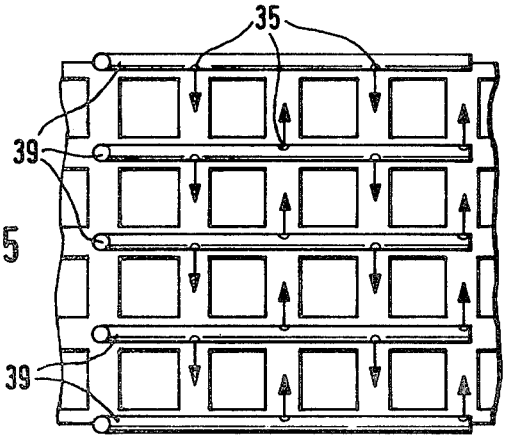
FIG. 5, in a simplified plan view, shows a gas-treatment device for containers delivered in four rows.

The exemplary embodiment as shown in FIG. 4 is particularly applicable to small containers. The exemplary embodiment shown in FIG. 5 is suited to processing containers 2 delivered in four rows. Here, gas supply tubes 39 are disposed not only above the free rims of the containers 2 but also above the interconnected lateral rims of the containers 2 as well. The disposition of the gas outlet openings 35 is like that described in connection with the exemplary embodiments of FIGS. 1–3.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In an apparatus for the gas-treatment and closure of filled packaging containers with a foil strip, said apparatus including a support means for said containers, a closure device arranged to seal the foil strip to a laterally extending rim of said containers, a foil guide means arranged to direct said foil strip toward said containers in a plane inclined toward said closure device with respect to the plane in which the containers are conveyed, said apparatus further including gas supply lines which extend toward the closure device between the foil strip, the improvement wherein said foil guide has a stationary slideway arranged to overlap the inclined plane, and further that said gas supply lines extend over said lateral rims of the containers and has gas discharge openings directed toward one another such that a substantially wedge-shaped chamber is formed by said containers and said foil strip supported by said slideway and by said gas supply lines, and a transverse flow of the protective gas is created which passes between and into piles of the product in the containers.

2. An apparatus as defined by claim 1, characterized in that said gas outlet openings are disposed in a staggered manner on alternate sides of the containers as said containers travel longitudinally of said conveyors.

3. An apparatus as defined by claim 2, characterized in that said gas outlet openings on at least one of said gas supply lines are spaced apart by at least two container lengths.

4. An apparatus as defined by claim 1, characterized in that said wedge-shaped chamber further includes inwardly directed strip means along which said rims of said containers slide and thereby cause said container to travel into a constricted zone and at the termination of such constricted zone said film is applied to said container rims by said closure device.

* * * * *